United States Patent [19]

Mayer et al.

[11] 4,218,593

[45] Aug. 19, 1980

[54] LOW RESISTANCE SELECTOR SWITCH

[75] Inventors: Robert W. Mayer, Hackettstown; Adam Smorzaniuk, West Millington, both of N.J.

[73] Assignee: Amerace Corporation, New York, N.Y.

[21] Appl. No.: 908,366

[22] Filed: May 22, 1978

[51] Int. Cl.[2] ..... H01H 19/58

[52] U.S. Cl. ..... 200/11 TW; 200/11 DA; 200/292

[58] Field of Search ..... 200/11 R, 11 DA, 11 G, 200/11 TW, 264, 265, 155 R, 155 A, 303, 316, 292

[56] References Cited

U.S. PATENT DOCUMENTS

| | | | |
|---|---|---|---|
| 2,735,907 | 2/1956 | Inman | 200/292 |
| 2,847,523 | 8/1958 | Van Amelsfort | 200/292 |
| 3,089,923 | 5/1963 | Wright | 200/11 TW |
| 3,261,929 | 7/1966 | Neff, Jr. | 200/292 |
| 3,366,751 | 1/1968 | Capellari | 200/11 TW |
| 3,558,834 | 1/1971 | Zielke | 200/11 TW |
| 3,621,162 | 11/1971 | Wall | 200/11 DA |
| 3,648,002 | 3/1972 | DuRocher | 200/265 |

*Primary Examiner*—James R. Scott

*Attorney, Agent, or Firm*—Richard A. Craig; Arthur Jacob

[57] ABSTRACT

A selector switch of the type having a thumbwheel selector journalled for rotation in a frame for selecting any one of a plurality of interconnections among external circuits to be connected to electrical contacts mounted in the frame, the selector including a first part of dielectric material and a second part with a metallic electrically conductive material carried by the first part and having a pattern configured in accordance with a predetermined code, portions of the metallic electrically conductive material and the first part lying in a common contact surface so as to be contacted by various ones of the electrical contacts in different positions of the selector to connect and disconnect the contacts in accordance with the pattern of conductive material, thereby selectively closing and opening the interconnections among the external circuits.

20 Claims, 4 Drawing Figures

LOW RESISTANCE SELECTOR SWITCH

BACKGROUND OF THE INVENTION

1. Field of the Invention

The present invention relates generally to selector switches and pertains, more specifically, to a selector switch of the type having multiple poles, or contacts, among which connections are made in accordance with the selective positioning of a coded element of the switch.

2. Description of the Prior Art

Conventional selector switches, such as currently available thumbwheel selector switches, employ coded elements which usually include patterns of metallic conductive material carried upon a dielectric substrate for effecting the desired interconnections among the poles of the switch. The patterns are constructed in the form of conventional "printed circuits" in which the coded pattern is etched on a printed circuit board. Usually, the metallic circuit portions are plated with gold to provide an oxide-free contact surface for electrical switching of low level signals, and for low contact resistance. The metallic circuit portions are contacted by electrical contacts which are resiliently biased toward the contact surface. As a result of the conventional techniques employed in the manufacture of the coded elements, the metallic circuit portions usually are raised above the level of the surrounding portions of the dielectric substrate. Thus, relative movement between the coded element and the electrical contacts during selective repositioning of the coded element relative to the electrical contacts requires that the electrical contacts ride over each raised edge of the metallic circuit portions encountered during such movement, resulting in uneven forces required during selection and excessive abrasion and wear on the contact surfaces of the electrical contacts.

In an earlier patent application, Ser. No. 856,728, filed Dec. 1, 1977, we describe a selector switch in which a coded element includes a pattern of non-metallic electrically conductive material for effecting the desired interconnections among the various poles of the switch. While that construction offers many advantages, the contact resistance may not be low enough for all installations where selector switches of the same general type otherwise would be useful.

It is an object of the present invention to provide a selector switch in which the selector includes a pattern of electrically conductive material at least a portion of which is a metallic pattern and makes contact with the electrical contacts of the switch, the metallic pattern being at the same elevation as the contiguous dielectric material of the selector at the transition between the metallic pattern and the dielectric material.

Another object of the invention is to provide a selector switch of the type described in which the selector includes a pattern of metallic electrically conductive material integral with a dielectric material, the conductive material and dielectric material being carried in an insert placed in a rotor journalled for rotation among selected positions for effecting the desired interconnections among external circuits connected to the switch, the surface of the electrically conductive material being flush with the surface of the dielectric material in a common contact face.

Still another object of the invention is to provide a selector switch of the type described and in which the selector is constructed of integrally molded first and second parts, the first part being a dielectric synthetic resin material and the second part being a conductive synthetic resin material molded in a pattern configured in accordance with the particular code desired in the coded element of the switch and plated with a metal, such as gold, for relatively low contact resistance and for inhibiting corrosion or oxidation.

Yet another object of the invention is to provide a selector switch of the type described and in which the selector is constructed of a molded dielectric synthetic resin material with a metal member embedded in the dielectric material of the selector, the metal member having a pattern configured in accordance with the particular code desired in the coded element of the switch and a surface flush with the surface of the surrounding dielectric material.

A further object of the invention is to provide a selector switch of the type described and in which the poles, or contacts, are in the form of contact pins having a configuration, dimensions and arrangement suitable for mounting the switch in conventional sockets or receptacles, or directly onto printed circuit boards, to connect the switch to external circuits.

A still further object of the invention is to provide a selector switch of the type described which enables relatively smooth operation and is accurate and reliable and will perform effectively over a long period of use.

Still another object of the invention is to provide a selector switch of the type described which is economical to fabricate utilizing current manufacturing techniques, and is constructed of relatively low-cost materials without sacrificing reliable operation.

SUMMARY OF THE INVENTION

The above objects, as well as still further objects and advantages, are attained by the present invention, which may be described briefly as a selector switch for selecting any one of a plurality of interconnections among external circuits to be connected to the switch, the interconnections being made in accordance with a predetermined code, the selector switch comprising a frame, a selector mounted for movement relative to the frame to any one of a plurality of fixed relative positions, the selector including a first part of dielectric material and a second part of electrically conductive material, the selector having a contact face and the second part including a metallic portion having a pattern extending along the contact face of the selector, the pattern being configured in accordance with the predetermined code, and a plurality of electrical contacts affixed to the frame, the contacts having circuit connection portions for connection to the external circuits, and contact surfaces juxtaposed with the contact face of the selector such that movement of the selector relative to the frame to one of the fixed positions will electrically connect and disconnect the contacts in accordance with the pattern of the conductive material at the contact face of the selector to close and open the interconnections among the external circuits, each contact surface being aligned with a path of travel on the contact face of the selector, at least some of the paths of travel including first segments lying along the first part of the selector and second segments lying along the second part of the selector and essentially contiguous with the next adjacent first segment, the elevation of the first segments being the same as the elevation of the second segments at the transition from one to the other of the first and second segments of such paths of travel so as to establish a smooth transition between the first and second parts for each contact surface.

BRIEF DESCRIPTION OF THE DRAWING

The invention will be more fully understood, while still further objects and advantages will become apparent, in the following detailed description of preferred embodiments of the invention illustrated in the accompanying drawing, in which.

DESCRIPTION OF THE PREFERRED EMBODIMENTS

Figure 1:
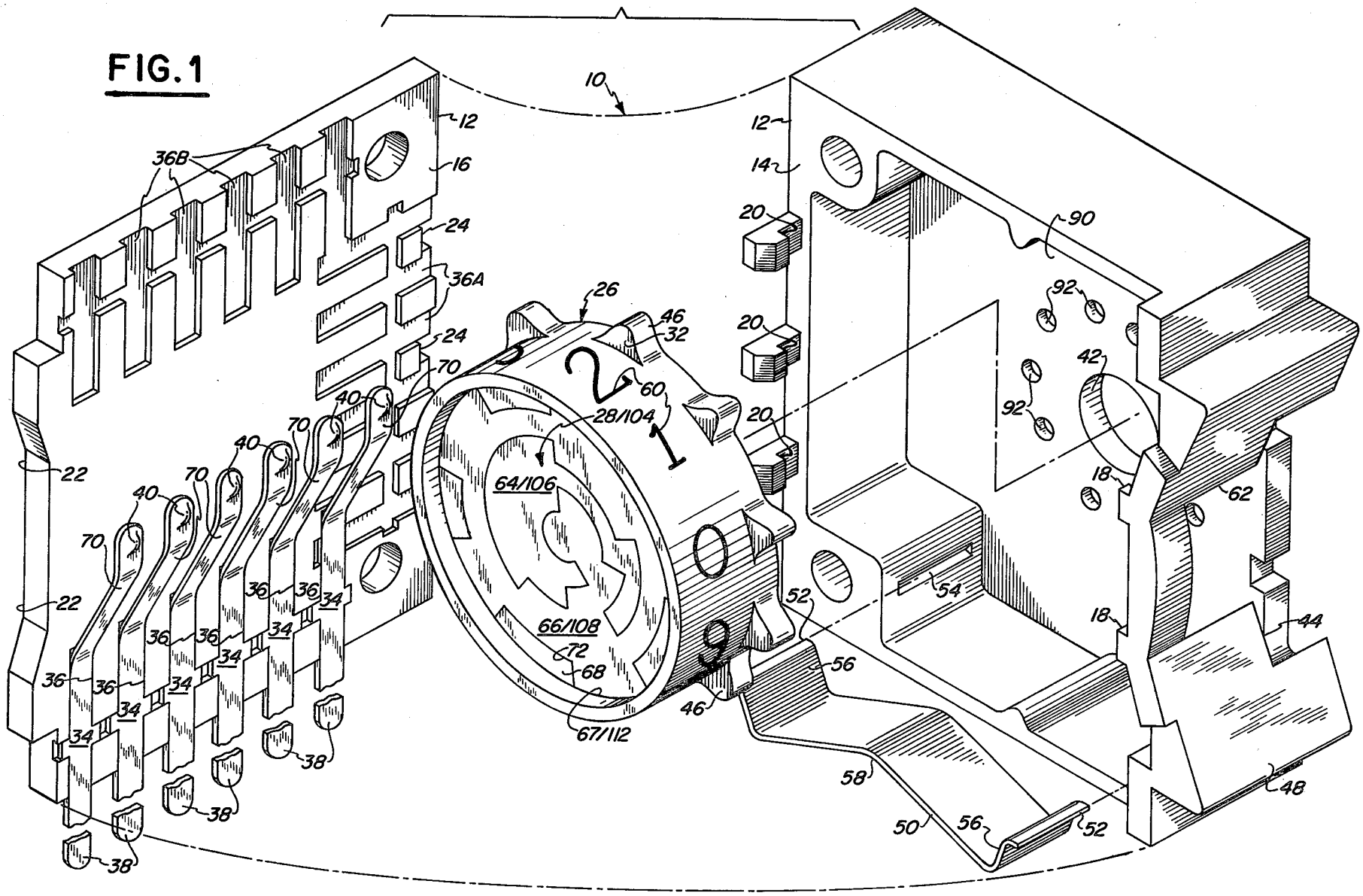
FIG. 1 is an exploded perspective view of a thumbwheel selector switch constructed in accordance with the invention.

Referring now to the drawing, and especially to FIG. 1 thereof, a selector switch constructed in accordance with the invention is illustrated in the form of a thumbwheel selector switch 10. Switch 10 has a frame 12 which includes members 14 and 16 located relative to one another and secured in assembled relationship by shoulders 18 and resiliently deflectable latches 20 which are integral with member 14 and engage corresponding portions 22 and 24 of member 16 to secure the members together.

A selector, shown in the form of a rotor 26, has a disk-like central portion in the form of an insert 28, an axially extending stub shaft 30 and a radially projecting thumbwheel 32. The member 16 is dielectric and carries a plurality of electrical contacts 34 affixed within complementary recesses 36 in the member 16 and electrically insulated from one another. Contacts 34 have circuit connection portions, or poles, in the form of connector pins 38 projecting outwardly from member 16 and contact surfaces 40 at the ends of the contacts opposite the connector pins 38. Member 16 of frame 12 of switch 10 includes alternate sets of recesses 36A and 36B so that the electrical contacts 34 may be affixed within any selected set of recesses 36, 36A or 36B to provide connector pins 38 projecting from the bottom, rear or top of the switch 10.

Figure 2:
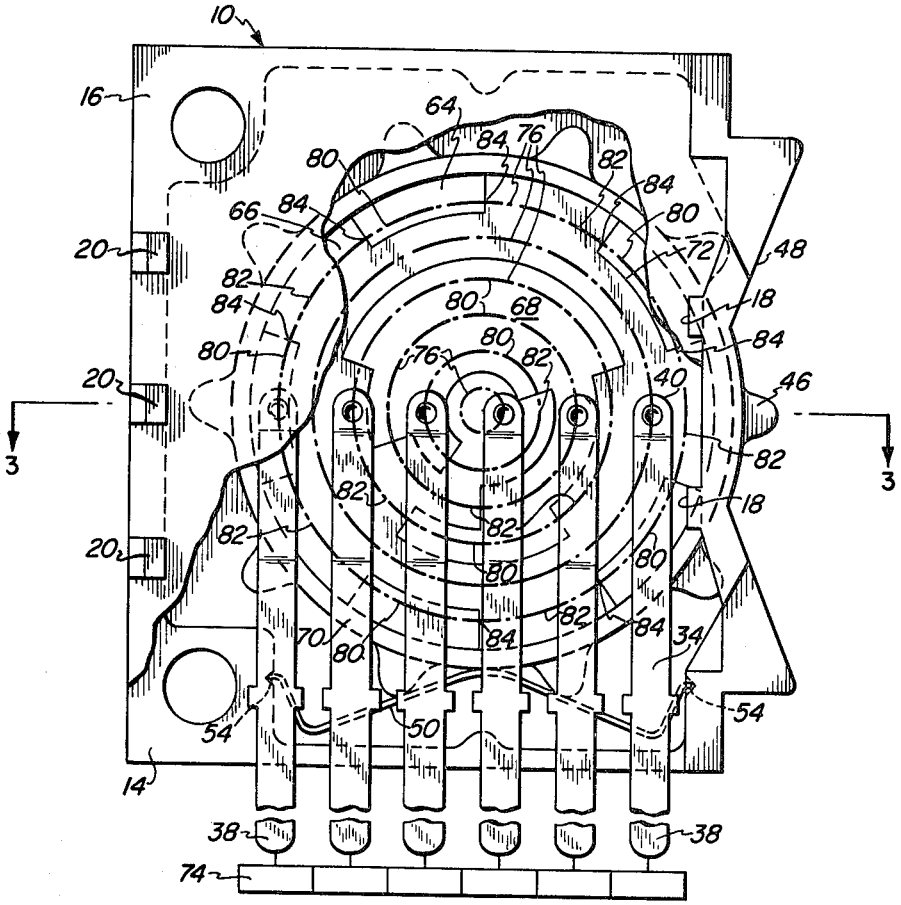
FIG. 2 is an elevational view of the switch in assembled configuration with portions cut away to reveal internal component parts.
Figure 3:
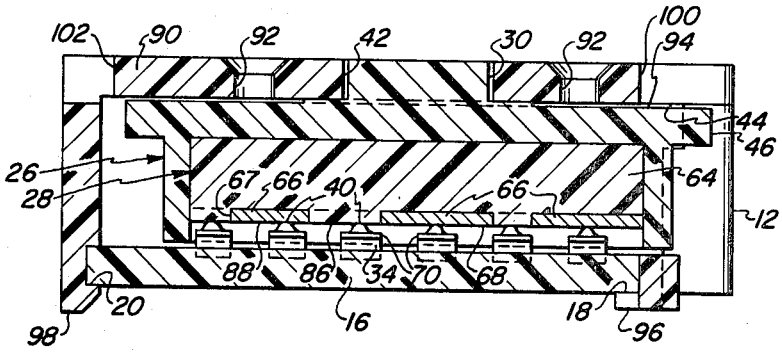
FIG. 3 is a cross-sectional view taken along line 3—3 of FIG. 2.

Turning now to FIGS. 2 and 3, as well as to FIG. 1, rotor 26 is journalled for rotation in frame 12 by virtue of stub shaft 30 being received within a complementary cylindrical bore 42 within member 14. A slot 44 in the member 14 enables the individual projections 46 of the thumbwheel 32 to extend through the member 14, and the contour of front surface 48 of member 14 permits access to the outwardly extending projections 46 by an operator's thumb such that thumbwheel 32 and the rotor 26 may be rotated by pushing the operator's thumb against each projection 46 as the projections arrive at slot 44. A detent spring 50 is mounted in member 14 by means of end tabs 52 which are received within grooves 54 in member 14. End tabs 52 are located on legs 56 of detent spring 50, and a detent element 58 is located between the legs 56. Detent element 58 engages the thumbwheel 32 between adjacent projections 46 to define fixed positions among which the rotor 26 can be indexed. Each position of the rotor is indicated by indicia in the form of characters 60 made visible through a window 62 in the member 14. Thus, each position has an associated projection 46 at the slot 44 and an associated character 60 at window 62.

Insert 28 of rotor 26 is constructed of first and second parts shown in the form of elements 64 and 66. The first element 64 is fabricated of a dielectric material, preferably in the form of a synthetic resin material. The second element 66 is in the form of a metal member 67 and is electrically conductive. Second element 66 is embedded in first element 64 with both elements lying in a common surface at a contact face 68 of the insert 28 of rotor 26. Contact surfaces 40 of electrical contacts 34 are urged against contact face 68 of the insert 28 by the resilient biasing force of each arm 70 of each electrical contact 34, contacts 34 being of resiliently deflectable metallic construction.

Second element 66 presents a pattern 72 of conductive material at the contact face 68. Pattern 72 is configured in accordance with a predetermined code so that for each position of rotor 26, certain of the electrical contacts 34 are in contact with the second element 66 at the contact face 68 and therefore are in electrical contact with one another. Others of the electrical contacts 34 are in contact with the first element 64 at the contact face 68 and therefore are not in electrical contact with any other contacts 34. In this manner, each position of the rotor 26 provides a corresponding combination of interconnections detectable at the connector pins 38. External circuits 74 operate in response to the coded combination of interconnections to actuate further devices in accordance with the selection made at switch 10.

Because of the configuration of pattern 72 on contact face 68, at least some of the contact surfaces 40 alternately engage element 64 and element 66 in the various positions of rotor 26. Each contact surface 40 is aligned with a path of travel 76 followed by relative movement of rotor 26 and contacts 34. The paths of travel 76 of at least some of the contact surfaces 40 over the contact face 68 include first segments 80 lying along element 64 and second segments 82 lying along element 66. In order to assure a smooth transition between element 64 and element 66 for each contact surface 40, the first segments 80 and contiguous second segments 82 are placed at the same elevation at the transition 84 from one to the other of the contiguous segments 80 and 82. The placement of segments 80 and 82 at the same elevation at transition 84 preferably is attained by assuring that the outer surface 86 of element 64 is flush with the outer surface 88 of element 66. Smooth operation and consistent operating forces are facilitated by rendering contact face 68 generally planar and having outer surfaces 86 and 88 lie in the plane of contact face 68. In this manner contact surfaces 40 tend to remain at the same elevation during rotation of rotor 26, providing the desired smoothness and consistency in operating forces. In addition, wear upon the contact surfaces 40 is reduced to a minimum since the smooth transition 84 tends to eliminate abrasion which might otherwise take place as the contact surfaces ride over the interface between the conductive material of element 66 and the surrounding dielectric material of element 64. Thus, where the surface 88 of element 66 and the contact surfaces 40 are plated with a material which inhibits oxidation and corrosion, such as gold, wear of the plating will be retarded and the useful service life of the switch 10 will be extended.

In the preferred construction, all of the contacts 34 may be of identical construction. The contacts 34 extend parallel to one another and project beyond the frame 12 to provide the connector pins 38. Connector pins 38 are arranged in an array which includes a row of pins 38 spaced equidistant from one another and suitable for direct insertion into a standard socket or receptacle, such as the now ubiquitous IC socket. Pins 38 can be constructed in various configurations and dimensions and arranged to be inserted directly into a printed circuit board, if desired. It is a relatively simple matter to re-orient the contacts 34 so that the pins 38 will project from the frame in another direction, thereby enabling the switch 10 to be adapted for mounting in various orientations.

Wall 90 of member 14 is provided with a plurality of apertures 92 which are aligned with a C-shaped recess 94 in rotor 26. A pin (not shown) may be placed within any one selected aperture 92 to enter recess 94 and provide a stop at a selected position of rotor 26, in a now well-known manner.

It is noted that shoulder 18 and latches 20 of member 14 include outwardly-projecting portions 96 and 98, while complementary slots 100 and 102 are provided at the opposite side of member 14. In this manner, like switches 10 can be located side-by-side in nested relationship in an installation, with portions 96 and 98 entering slots 100 and 102, respectively.

Figure 4:
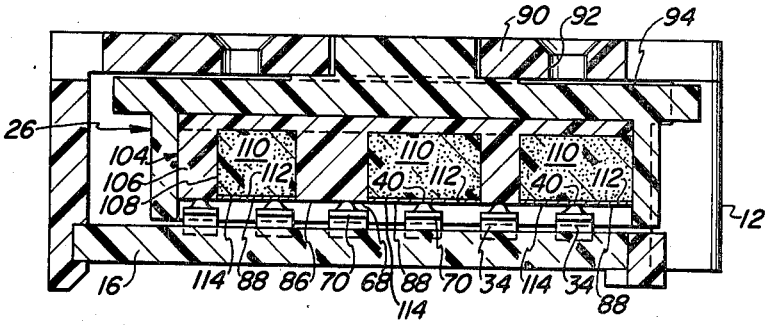
FIG. 4 is a cross-sectional view similar to FIG. 3, but showing an alternate embodiment constructed in accordance with the invention.

Referring now to FIG. 4, an alternate embodiment is illustrated in which the rotor 26 of switch 10 is again constructed with an insert having first and second parts shown in the form of insert 104 having first and second elements 106 and 108, but element 108 includes a portion of non-metallic electrically conductive material in the form of further element 110 embedded in first element 106. Further element 110 carries a layer 112 of metal which is plated on further element 110 and overlies element 110. The plated layer 112 provides the outer surface 88, which is flush with outer surface 86 in the plane of contact face 68, and which facilitates the low contact resistance and superior wear qualities between the contact surfaces 40 and the element 108.

Preferably, the material of further element 110, which is beneath layer 112, is an electrically conductive synthetic resin material. The construction of the insert 104, as shown in FIG. 4, enables the use of simplified techniques for the manufacture of the rotor. For example, elements 106 and 110 can be molded of thermoplastics in a two-shot molding operation to establish an integrally molded insert 104, with element 110 having a surface 114 configured as pattern 72 but recessed below the surface 86 of the surrounding dielectric material of element 106. The layer 112 is then electroplated onto element 110 to establish a precise pattern 72 of a desired metal, the surface 88 of which is flush with the surface 86 of the surrounding dielectric material of element 106. Various configurations for pattern 72 are thus fabricated easily to provide for different codes. The selection of a desired code is readily provided by merely choosing an appropriate insert and assembling the insert within rotor 26.

It is to be understood that the above detailed description of preferred embodiments of the invention are provided by way of example only. Various details of design and construction may be modified without departing from the true spirit and scope of the invention, as set forth in the appended claims.

The embodiments of the invention in which an exclusive property or privilege is claimed are defined as follows:

1. A selector switch for selecting any one of a plurality of interconnections among external circuits to be connected to the switch, the interconnections being made in accordance with a predetermined code, said selector switch comprising:

a frame;

a selector mounted for movement relative to the frame to any one of a plurality of fixed relative positions;

the selector including a first part of dielectric material and a second part of electrically conductive material, the selector having a contact face and the second part including a metallic portion having a pattern extending along the contact face of the selector, the pattern being configured in accordance with the predetermined code;

the second part including a portion of non-metallic electrically conductive material beneath the metallic portion, and the metallic portion comprising a plating of metal overlying the non-metallic portion; and a plurality of electrical contacts affixed to the frame, the contacts having circuit connection portions for connection to the external circuits, and contact surfaces juxtaposed with the contact face of the selector such that movement of the selector relative to the frame to one of said fixed positions will electrically connect and disconnect the contacts in accordance with the pattern of the conductive material at the contact face of the selector to close and open the interconnections among the external circuits;

each contact surface being aligned with a path of travel on the contact face of the selector, at least some of the paths of travel including first segments lying along the first part of the selector and second segments lying along the second part of the selector and essentially contiguous with the next adjacent first segment, the elevation of the first segments being the same as the elevation of the second segments at the transition from one to the other of the first and second segments of such paths of travel so as to establish a smooth transition between the first and second parts of each contact surface.

2. The invention of claim 1 wherein the first part has an outer surface lying in the contact face;

the second part has an outer surface lying in the contact face; and the outer surfaces are flush with one another.

3. The invention of claim 2 wherein the contact face is planar and the outer surfaces lie in the plane of the contact face.

4. The invention of claim 1, 2 or 3 wherein the non-metallic portion is an electrically conductive synthetic resin material.

5. The invention of claim 4 wherein the first part of the selector is a dielectric synthetic resin material.

6. The invention of claim 5 wherein the non-metallic portion is molded integrally with the first part of the selector.

7. The invention of claim 6 wherein each of the first part and the non-metallic portion of the second part is a thermoplastic synthetic resin material.

8. The invention of claim 1, 2 or 3 wherein the second part includes a metal member embedded in the first part.

9. The invention of claim 8 wherein the first part of the selector is a dielectric synthetic resin material.

10. A selector switch for selecting any one of a plurality of interconnections among external circuits to be connected to the switch, the interconnections being made in accordance with a predetermined code, said selector switch comprising:

a frame;

a selector mounted for movement relative to the frame to any one of a plurality of fixed relative positions;

the selector including a first part of dielectric material and a second part of electrically conductive material, the selector having a contact face and the second part including a metallic portion having a pattern extending along the contact face of the selector, the pattern being configured in accordance with the predetermined code;

the selector further including a rotor journalled in the frame for rotation relative to the frame, the rotor including an insert carrying the first and second parts, and means affixing the insert to the rotor for rotation therewith; and a plurality of electrical contacts affixed to the frame, the contacts having circuit connection portions for connection to the external circuits, and contact surfaces juxtaposed with the contact face of the selector such that movement of the selector relative to the frame to one of said fixed positions will electrically connect and disconnect the contacts in accordance with the pattern of the conductive material at the contact face of the selector to close and open the interconnections among the external circuits;

each contact surface being aligned with a path of travel on the contact face of the selector, at least some of the paths of travel including first segments lying along the first part of the selector and second segments lying along the second part of the selector and essentially contiguous with the next adjacent first segment, the elevation of the first segments being the same as the elevation of the second segments at the transition from one to the other of the first and second segments of such paths of travel so as to establish a smooth transition between the first and second parts for each contact surface.

11. The invention of claim 10 wherein:

the first part has an outer surface lying in the contact face;

the second part has an outer surface lying in the contact face; and the outer surfaces are flush with one another.

12. The invention of claim 11 wherein the contact face is planar and the outer surfaces lie in the plane of the contact face.

13. The invention of claim 10, 11 or 12 wherein the circuit connection portions of the electrical contacts project from the frame and are arranged in a prescribed array.

14. The invention of claim 13 wherein the circuit connection portions comprise connector pins and the prescribed array includes a row of connector pins spaced equidistant from one another.

15. The invention of claim 10, 11 or 12 wherein the second part includes a metal member embedded in the first part.

16. The invention of claim 15 wherein the first part of the selector is a dielectric synthetic resin material.

17. The invention of claim 10, 11 or 12 wherein the second part includes a portion of non-metallic electrically conductive material beneath the metallic portion and the metallic portion comprises a plating of metal overlying the non-metallic portion.

18. The invention of claim 17 wherein the non-metallic portion is an electrically conductive synthetic resin material.

19. The invention of claim 18 wherein the first part of the selector is a dielectric synthetic resin material.

20. The invention of claim 19 wherein the non-metallic portion is molded integrally with the first part of the selector.

* * * * *